US005299963A

United States Patent [19]

Isensee

[11] Patent Number: 5,299,963

[45] Date of Patent: Apr. 5, 1994

[54] WATER SKI APPARATUS AND METHOD

[76] Inventor: Paul D. Isensee, P.O. Box 23180, Richfield, Minn. 55423

[21] Appl. No.: 968,425

[22] Filed: Oct. 29, 1992

[51] Int. Cl.[5] ..... A63C 15/00

[52] U.S. Cl. ..... 441/79; 441/68

[58] Field of Search ..... 114/130, 138, 140, 141, 114/39.2, 266, 267, 364, 357; 441/68, 74, 79

[56] References Cited

U.S. PATENT DOCUMENTS

| | | | |
|---|---|---|---|
| 3,073,271 | 1/1963 | Brill | 114/266 |
| 3,422,471 | 1/1969 | Morey et al. | 441/79 |
| 4,316,425 | 2/1982 | Guido et al. | 114/141 |
| 4,439,166 | 3/1984 | Maxwell | 441/79 |
| 5,148,761 | 9/1992 | Winner | 441/79 |

FOREIGN PATENT DOCUMENTS

| | | | |
|---|---|---|---|
| 8807883 | 10/1988 | PCT Int'l Appl. | 441/79 |

*Primary Examiner*—Edwin L. Swinehart

*Attorney, Agent, or Firm*—Merchant, Gould, Smith, Edell, Welter & Schmidt

[57] ABSTRACT

An improved water ski apparatus and method are disclosed. A slalom water ski having an adjustable rudder fin is configured such that the rudder fin can be selectively and precisely moved in vertical, horizontal and diagonal directions in a manner such that each movement parameter can be separated from the others and is precisely moveable to within thousandths of an inch accuracy, in calibrated manner. Means are provided to enable complete removal of the rudder fin from the ski, and subsequent replacement while exactly preserving the last adjusted mounting position of the fin relative to the ski. An improved fastening technique for mounting the rudder fin to the ski body without loosening or stripping of the fastening members is also disclosed, as well as a method for fabricating a ski body that integrally incorporates the improved fastening members in the body of the ski.

25 Claims, 2 Drawing Sheets 20a
21
20c
20
20d
20b
30
40
32
3
47
40b
41
40a
43
44
42a
42
47a
34
23
49
46
41a
32a
35

FIG. 5
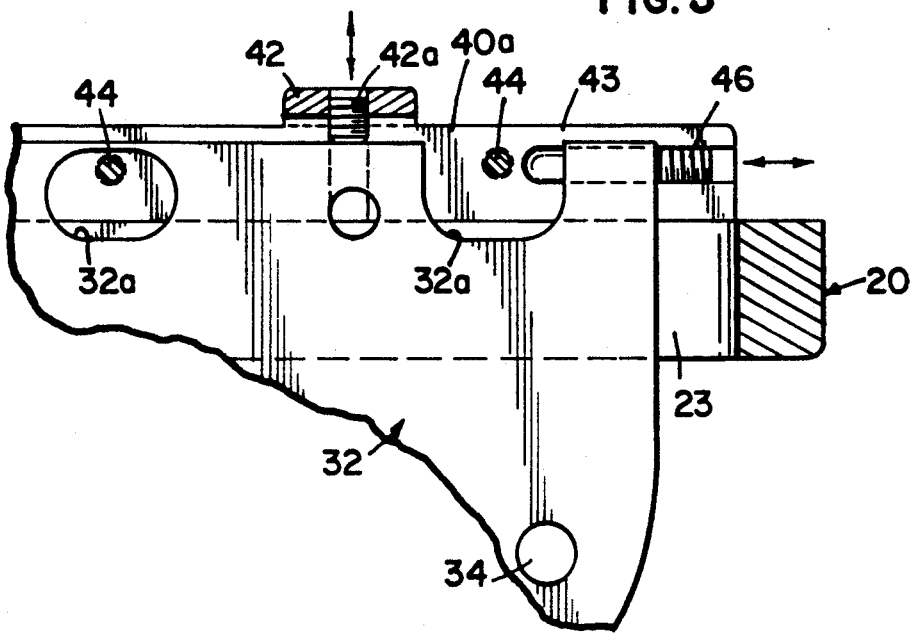
FIG. 6
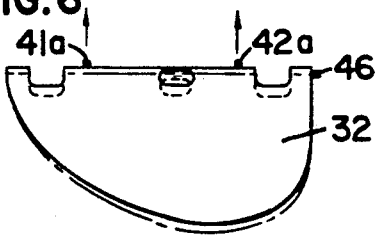
FIG. 9
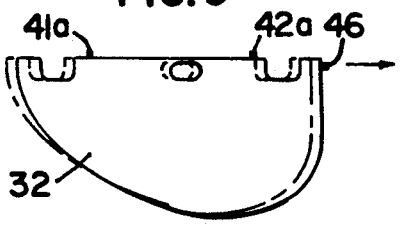
FIG. 7
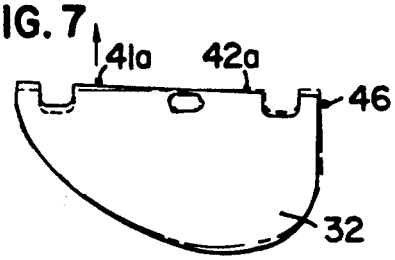
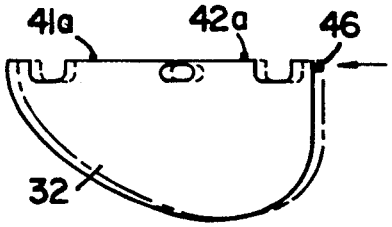
FIG. 8
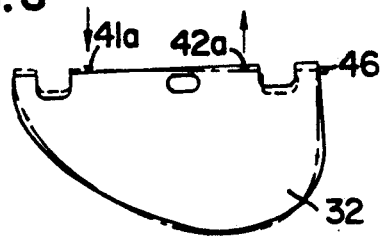
FIG. 10
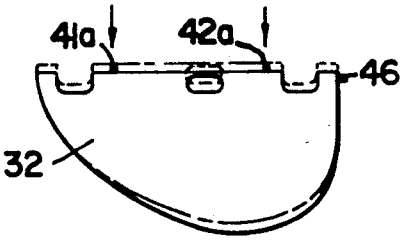
FIG. 11

WATER SKI APPARATUS AND METHOD

FIELD OF THE INVENTION

This invention relates generally to water skiing apparatus, and more particularly to a water ski having an improved rudder fin assembly.

BACKGROUND OF THE INVENTION

As the sport of water skiing has developed, so has the need for high quality, high performance water skis. Improved materials technology has practically revolutionized the water ski industry, providing new and improved water skis from recreational to highly competitive ski applications.

As the sophistication of skiers increases, there has been a significant increase in the demand for more precise and more responsive high performance slalom skis. Technological improvements have been made in numerous aspects of the water ski, including: new composite ski materials such as the most recent graphite materials, the overall outline shape and size of the ski, the shaping and contouring profile of the ski bottom, improved foot retaining supports or boots, and improved rudder and stabilizing fin configurations. Of these, the performance of a given ski configuration can be significantly altered by the rudder fin assembly.

The performance of a ski can be "customized" to the unique needs and abilities of an individual skier by making very slight adjustments in the trailing rudder fin assembly of the ski. The skier must to some extent adjust to the performance capabilities of the ski. However, since each skier has different weight, strength and athletic ability than the next, variability of the rudder fin to change the performance of the ski permits fine tuning so as to conform or customize the ski to the individual skier and the particular water conditions of the day.

Besides the development of unique designs of the fin shape and apertures therethrough, it is generally known that by moving the fin (i.e., up or down in the vertical direction and forward or backward in the longitudinal direction) relative to the ski, one can significantly alter the manner in which the ski performs on its turning edge and on its pulling edge. Such fin movement in predetermined directions enables the skier to optimize the force required to initiate turns or to angle across wakes, to improve turn stability, to regulate turn speed, to raise or lower the ski tip and the amount of ski in the water on turns and to control the ski edging. For example, moving the fin rearward on the ski slows the aggressiveness at which the ski turns on the skier's "On Side" (i.e., the skier&3 s side corresponding to his forward foot on the ski). Moving the ski down, or deeper into the water, raises the tip of the ski so that the curvature of the ski tip does not "grab" as much water, enabling the ski to complete the turn more slowly. Besides movement of the entire fin in the vertical or longitudinal directions, it is possible to selectively raise or lower only the leading or trailing edge of the fin, to address unique performance compensation requirements of the individual skier (as hereinafter described in more detail).

Since the ski will perform differently in response to each movement of the fin, ideally only one fin movement adjustment should be made at a time to minimize the effects of multiple performance characteristics. While fin movement has been possible in the prior art, heretofore known fin adjustment structures have not enabled fin adjustments to be made with any degree of precision or in a manner which permits isolation of a single fin adjustment at a time. Further, known fin adjustment techniques have no "memory" associated with the adjustment. For example, it is desirable and convenient to be able to remove the fin from the ski while traveling, to prevent damage thereto. Yet, with known fin adjustment techniques such removal of the fin results in loss of the last fin adjustment position, since it is virtually impossible to reinsert the fin back into the ski in the exact position from which it was removed, with any degree of certainty. The present invention addresses the above needs of the water ski industry by providing both a precisionally adjustable fin member that can be entirely removed from the ski and reinstalled in precisely the same position it occupied prior to removal.

A further problem associated with known fin assemblies used with skis fabricated from high-technology composites has been the tendency for the fasteners for such fin assemblies to loosen and strip from the ski body. This has particularly been a problem with the recent ski configurations that have their base material configured entirely of composite materials with no aluminum or metal sheet facing materials. Obviously, the fin and its securing bracket are subjected to tremendous pressures during operative use of the ski. Since the fin assembly is located at the back end of the ski which typically tapers to a fairly narrow width, there is relatively little ski based material available for accommodating the fin assembly anchor screws or bolts, which are generally fairly small in cross-section. As a result, the pressure and vibration transmitted through the fin assembly rapidly causes the screw or bolt fasteners holding them in place to loosen within the composite base material and oftentimes entirely strip from the ski body, rendering the ski inoperative and making repair and replacement costly and difficult. The typical method of repairing a stripped fin assembly anchor bolt hole has been to bore out the stripped hole, to fill the bore with an epoxy and metal compound, to allow the compound to harden, and to rethread the anchor screw or bolt into the hardened material. While such replacement material lasts for a while, it generally tends to strip in the same manner as the original composite ski material, requiring the process to be repeated.

The fin assembly of the present invention provides a reliable and durable mounting configuration for the fin assembly which is not susceptible to stripping during normal operative use of the ski and which provides for accurate placement and alignment of the fin assembly relative to the ski during the manufacturing process—an advantage that is generally not possible with known ski fabrication techniques.

SUMMARY OF THE INVENTION

The present invention provides for calibrated precision adjustment of the rudder fin member of a water ski that permits each parameter of the adjustment to be performed individually and accurately so that the water ski user can determine the effect of each adjustment on the performance of the ski. The invention enables each adjustment to be made without affecting or changing a prior adjustment that the user does not wish to alter. Accordingly, the present invention eliminates the need for measurement devices heretofore used in adjusting the position or alignment of the rudder fin member of a ski, to ensure repeatability or accuracy of adjustment. The present invention permits complete removal of the rudder fin member from the ski, for example as may be desired during transport of the ski, and the reinsertion of the rudder fin member into the ski following transport, at exactly the same adjusted position at which it was immediately prior to removal from the ski. The calibrated adjustment technique of the present invention enables accurate and determinable adjustment of the rudder fin member within thousandths of an inch in the vertical, longitudinal and diagonal directions relative to the general plane of the ski. The invention also includes an improved anchoring system for assuring a secure mount of the rudder fin assembly to the ski which will not loosen or strip under severe operative conditions, and a method for fabricating a ski with the improved anchoring structure.

According to one aspect of the invention, there is provided an improved water ski, comprising:

a. an elongated water ski body having top and bottom surfaces and longitudinally extending from a front end to a back end;

b. a rudder fin member generally symmetrically disposed about a plane of symmetry, operatively mounted to the ski body adjacent the back thereof and projecting outwardly from the bottom surface of the ski body; and c. means for selectively adjusting the operative position of the rudder fin member relative to the ski body, in calibrated manner, wherein the adjusting means enables independent calibrated adjustment movement of the ruder fin member in each of at least two degree of freedom directions within the plane.

The invention provides for independent calibrated movement of the rudder fin in a direction generally perpendicular to the bottom surface of the ski body, or in a direction generally parallel to the bottom of the ski body or for movement generally in the plane of the rudder fin member. According to a preferred embodiment of the invention, the fin adjusting means includes threaded means for imparting calibrated movement for adjusting the rudder fin member by an amount proportional to the rotation of the threaded means. According to another aspect of the invention, the adjusting means includes adjustable bearing surface means for engaging the rudder fin member along its peripheral edge surface in a manner that defines an adjusted resting position of the fin against the bearing surfaces.

According to another aspect of the invention, there is provided a water ski, comprising:

a. an elongated water ski body having top and bottom surfaces and longitudinally extending along an axis from front to back ends, wherein the ski body defines an axially aligned slot therethrough adjacent its back end;

b. a generally planar rudder fin member entrained within the slot and sized for movement within the slot;

c. means for securing the rudder fin member to the ski body at a desired operative position within the slot such that at least a portion of the rudder fin member projects outwardly from the bottom surface of the ski body; and d. adjustment means operatively connected with the rudder fin member for adjusting the operative position of the rudder fin member relative to the ski body, in calibrated manner; wherein the alignment means enables precise independent calibrated movement of the fin in predetermined increments in each of at least two degree of freedom directions within the general plane of the fin.

According to yet another aspect of the invention, there is provided an adjustable rudder fin assembly for a water ski which comprises:

a rudder fin member;

b. means connected with the rudder fin member for operatively securing the rudder fin member to the water ski body; and c. adjustment means operatively connected with the rudder fin member and with the securing means for independently selectively adjusting the operative position of the rudder fin member relative to the ski body, in at least two different degree of freedom directions in calibrated manner.

According to yet another aspect of the invention, there is provided an improved water ski, comprising:

a. a water ski body defining a bottom and longitudinally extending between front and back ends;

b. a rudder fin member having forward and rear edges, c. means for operatively mounting the rudder fin member to the ski body at a position adjacent the back end of the ski body; and d. adjustment means operatively connected with the rudder fin member for selectively adjusting the operative position of the rudder fin member relative to the ski body, in calibrated manner such that the forward and rearward edges of the fin can be independently adjustably positioned relative to the ski body bottom.

According to yet a further aspect of the invention, the water ski includes at least one fastener member nonremovably secured within the water ski body for mounting the rudder fin to the ski body. According to a preferred embodiment of the invention, the fastener member comprises a sleeve member of a type suitable for cooperatively retainably holding a threaded fastener, wherein the sleeve member comprises at least in part a material different from that material from which the ski body is formed so as to retard stripping of threads formed in the sleeve.

According to yet a further aspect of the invention, a method of fabricating a water ski is provided which comprises the steps of:

a. providing a mold having the general desired external shape of a water ski;

b. positioning a plurality of fastener members relative to the mold and at spaced positions therealong suitable for subsequent mounting of a rudder fin assembly thereby to the water ski;

c. filling the mold with hardenable core material to permanently embed the plurality of fastener members within the core material and to define the body of a water ski;

d. causing the core material to harden; and e. separating the hardened ski body from the mold.

According to this aspect of the invention, the fastener members can be accurately positioned at predetermined positions along the mold such that the position of the rudder fin assembly to be subsequently mounted to the ski body by the fastener members is repetitively consistently positioned relative to the ski body for every ski formed by the mold.

According to yet another aspect of the invention, the plurality of fastener members for mounting the rudder fin assembly to the ski can be implanted within the composite and core material of a ski following its molding operation by boring pilot holes at the desired fastener positions and by physically driving fastener sleeve members into the bored holes.

While the present invention will be described with respect to a preferred embodiment configuration thereof, it will be understood that the principles of the invention are not to be limited to the details of the embodiment described herein. For example, while a specific rudder and fin configuration will be described with respect to the preferred embodiment, it will be understood that other variations of rudder fin assemblies could equally well be employed. Further, by way of example, the calibrated adjustment technique of the present invention will be described herein with respect to one embodiment of such an adjustment feature which employs a plurality of threaded screw members for defining adjustable bearing surfaces for retainably aligning the rudder fin within a mounting clamp. It will be readily appreciated by those skilled in the art, that the invention is not limited to such preferred embodiment configuration, but would equally well include other configurations wherein the calibrated adjustment means may be directly connected to the rudder fin member for "pushing" and "pulling" the fin member to the desired adjusted position(s).

Also, while the preferred embodiment of the invention illustrates the adjustment means as forming a part of the hold-down clamp structure for the rudder fin, it will be understood that such adjustment feature could be housed independently of the fin and clamping structure. Alternatively, while the calibrated adjustment structure of the preferred embodiment acts directly on the rudder fin member in a two-part rudder fin and mounting clamp configuration, the fin and mounting member could be constructed in a single integral configuration which could employ calibrated adjustment means either as a part of the integral assembly or separate therefrom (as for example might be the case with replaceable adjustment pieces or shims that may be sold in bit form) for moving the entire integral assembly relative to the ski body. These and other variations of the invention will become apparent to those skilled in the art upon a more detailed description of the invention.

BRIEF DESCRIPTION OF THE DRAWING

Referring to the figures, wherein like numerals represent like parts throughout the several views:

FIG. 5 is an enlarged fragmented view of the upper rear portion of the adjustable fin assembly of FIG. 3, illustrating in more detail two of the calibrated fin adjustment features of the assembly;

FIG. 6 is a diagrammatic view of the fin portion of the adjustable fin assembly, illustrating adjustable movement of the entire fin in the upward vertical direction;

FIG. 7 is a diagrammatic view of the fin portion of the adjustable fin assembly, illustrating diagonal adjustable movement of the fin wherein the forward portion of the fin is independently adjusted in an upward vertical direction:

FIG. 8 is a diagrammatic view of the fin portion of the adjustable fin assembly, illustrating diagonal adjustable movement of the fin;

FIG. 9 is a diagrammatic view of the fin portion of the adjustable fin assembly, illustrating adjustable movement of the entire fin in the backward longitudinal direction;

FIG. 10 is a diagrammatic view of the fin portion of the adjustable fin assembly, illustrating adjustable movement of the entire fin in the forward longitudinal direction; and FIG. 11 is a diagrammatic view of the fin portion of the adjustable fin assembly, illustrating adjustable movement of the entire fin in the downward vertical direction.

DETAILED DESCRIPTION OF THE INVENTION

Figures 1, 2, 3, 4:
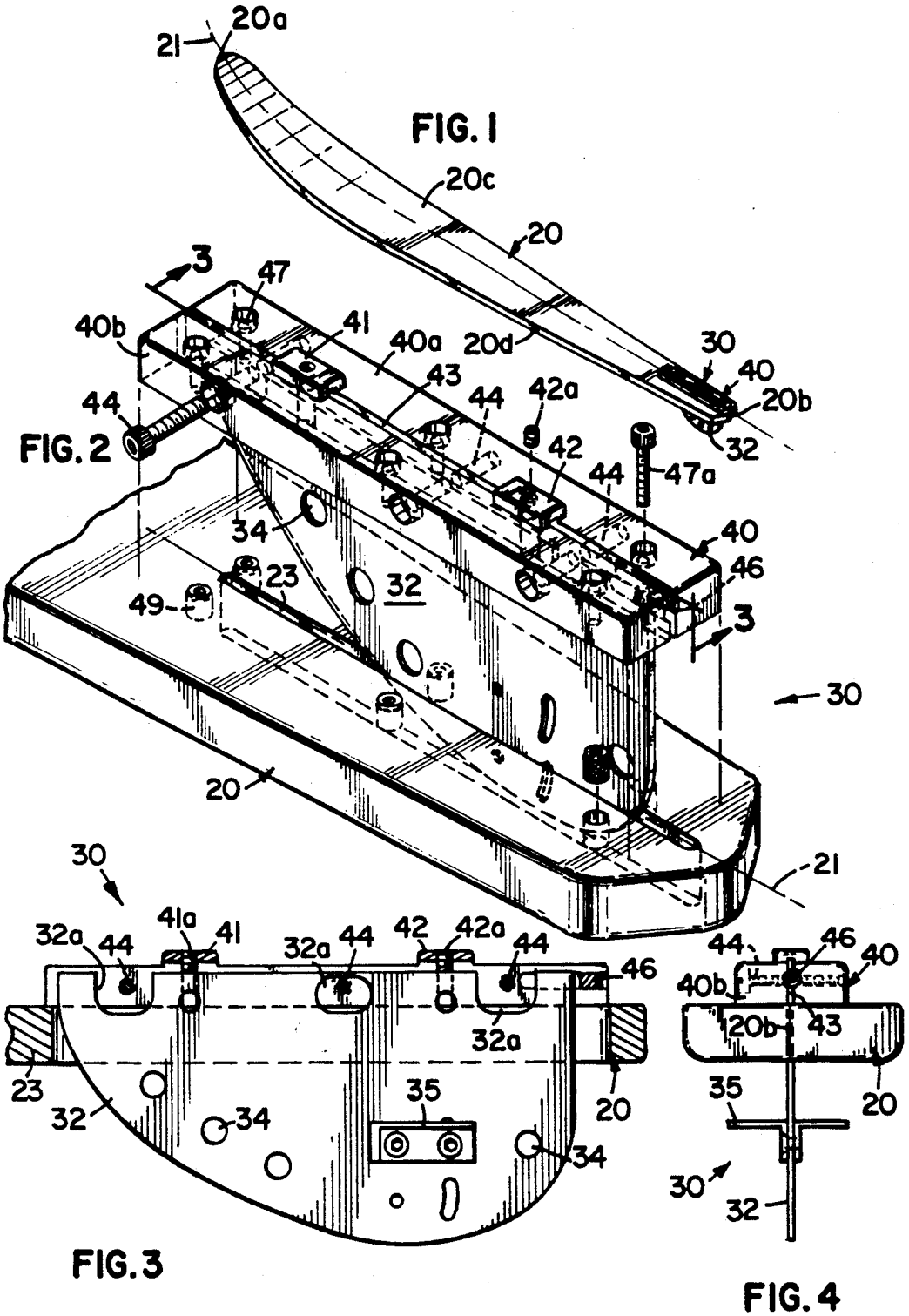
FIG. 1 is a perspective view of a typical water ski, without a boot assembly, incorporating the adjustable fin assembly of the present invention.
FIG. 2 is a partially exploded enlarged perspective view of the adjustable fin assembly portion of the ski of FIG. 1, illustrating the fin assembly as vertically lifted from its mounted operative position on the ski.
FIG. 3 is a cross-sectional view of the adjustable fin assembly of FIG. 2, as generally viewed along the Line 3—3 of FIG. 2.
FIG. 4 is a right end or rear view of the adjustable fin assembly portion of the ski illustrated in FIG. 2.

A simple, efficient and reliable embodiment of an apparatus that embodies the calibrated adjustment principles of the present invention is disclosed in the Drawing. Referring to FIG. 1, the body portion of a typical slalom water ski is illustrated at 20, extending between a front end 20*a* and a back end 20*b*. The water ski body 20 has an upper surface, generally illustrated at 20*c* and a lower surface 20*d*. The water ski body may assume a variety of sizes, configurations and shapes, and generally has a contoured bottom surface (not illustrated) as is well-known in the art. Generally, the ski is symmetrical about a longitudinal axis generally illustrated at 21 and tapers toward the axis at both the front and back ends, as illustrated in the figure. The ski illustrated in FIG. 1 does not include a foot support boot, which would be secured to the upper surface 20*c* of the ski at a position generally toward the middle of the ski.

The configuration of the ski illustrated is that of a high-performance slalom ski and may be configured of any suitable material. While early skis were constructed of wood and fiberglass, the body portions of more modern skis generally comprise a composite molded rigid foam material of high strength, light weight and improved performance characteristics. The core material is typically covered by a protective material. Also, while a protective layer of aluminum on their upper surface. Earlier claddings comprised more modern high-performance skis typically use composite laminate materials such as materials containing graphite.

Referring to the Drawing, a rudder fin assembly embodying the principles of the present invention is generally illustrated at 30, as mounted to the ski body 20 adjacent its back end 20*b*. Referring to FIG. 2, a more detailed view of the back end of the ski body and the improved rudder fin assembly of this invention is disclosed. The ski body has a longitudinal slot 23 formed or cut through the body along its longitudinal axis 21 and extending entirely through the ski body from the upper surface 20*c* to the lower surface 20*d*. The slot 23 stops short of the back end 20*b* of the ski, and is of a width and length adequate to accept a rudder fin member 32 therethrough. The length of the slot 23 is cooperatively sized with the rudder fin member 32 such that when the fin 32 is operatively mounted within the slot 23, there will be approximately one-half inch clearance between each of the longitudinal front and rear edges of the fin 32 and the opposite ends of the slot 23. The fin 32 is illustrated in an exploded (non-operative) position in FIG. 2. When in an operative position, the fin would be lowered into the slot 23 so as to operatively extend below the bottom surface 20*d* of the ski body, as illustrated in FIG. 1.

A mounting clamp 40 is sized and configured to cooperatively engage and secure the rudder fin for mounting to the ski body. In the preferred embodiment, the mounting clamp 40 includes a pair of spaced bar members 40*a* and 40*b* held in parallel spaced-apart relationship to one another by means of a pair of upper connecting members 41 and 42. In the preferred embodiment, the connecting members 41 and 42 are welded to the bar members 40*a* and 40*b* and define a uniform longitudinal gap 43 between the members 40*a* and 40*b* which is of a width that just permits sliding movement of the rudder fin member 32 therebetween. The rudder fin member 32 is entrained within the gap 43 and between the spaced clamp members 40*a* and 40*b*, as illustrated in FIGS. 2, 3 and 4. The maximum upper travel limit of the fin 32 within the clamp 40 is limited by the connecting members 41 and 42.

The connecting members 41 and 42 each defines a vertically threaded bore therethrough into which is threaded an adjustment set screw, 41*a* and 42*a* respectively, which each includes an allen head cap for permitting rotation of the set screws within the threaded bores of the connecting members 41 and 42. Therefore, when the set screws 41*a* and 42*a* are inserted within the connecting members 41 and 42, the upward travel of the rudder fin 32 is determined and limited by the vertical threaded positions respectively of the set screws 41*a* and 42*a*, the lower ends of which bear upon the upper edge of the rudder fin 32, as illustrated in FIG. 3.

The rudder fin 32 is retainably clamped between the clamping bars 40*a* and 40*b* by means of three screw fasteners 44 laterally extending in bores between the clamping bars 40*a* and 40*b* as illustrated in FIGS. 2 and 4. The lateral bore holes extending through clamping member 40*b* are unthreaded; whereas the aligned bore extensions within the clamping member 40*a* are threaded to threadably accept the clamping bolts 44. The bore portions of the clamping member 40*b* are countersunk as illustrated in FIG. 2 to concealably accept the allen head portions of the clamping bolts 44 and to provide the bearing surface for enabling the bolts 44 to exert tightening pressure to close the gap 43 in clamping manner against the opposite sides of the rudder fin 32. As illustrated in FIG. 3, the upper portion of the rudder fin 32 includes three cutouts 32*a* through which the clamping bolts 44 pass. The longitudinal length of the cutouts 32*a* are sized to enable fore and aft motion of the rudder fin 32 within the slot 43, as hereinafter described in more detail.

The end portions of the clamping members 40*a* and 40*b* are cooperatively threaded toward the back end of the ski, as illustrated in FIGS. 2, 3 and 4, to threadably house a third adjustment set screw 46. The set screw 46 also includes an allen head cap for enabling rotatable movement of the set screw within the cooperatively threaded hole. The rearward position of the rudder fin 32 within the slot 43 is determined by the threaded position of the set screw 46 within the cooperatively threaded hole, as illustrated in FIG. 3. As the set screw 46 is rotated in the clockwise direction, the end of the set screw 46 will bear upon the rear edge of the fin 32, urging the fin in the forward (relative to the ski) direction. When the set screw 46 is rotated in a counterclockwise direction, the fin 32 will be enabled to move in the backward direction until it comes into engagement with the set screw 46.

Each of the clamping bars 40*a* and 40*b* includes a plurality of vertically bored and countersunk holes 47 therethrough sized and configured to cooperatively accept anchor screws 47*a* for securing the clamping brackets 40*a* and 40*b* to the ski body. The anchor screws or bolts 47*a* (which also include allen type heads), are cooperatively threadably received by a plurality of anchor sleeve members 49 which are fixedly embedded within the composite material forming the ski body. The sleeve members 49 are preferably of metal for preventing stripping, and are preferably embedded within the ski body during fabrication of the ski during its molding operation, to prevent the anchor sleeves from pulling out of the ski body material. Such anchor sleeves are of a construction well-known in the art and will not be detailed herein. In the preferred embodiment, an anchor sleeve having a knurled external surface for retainably engaging the composite material of the ski is used, and is of a type manufactured by P. S. M. International under its Banc-Lok® trademark. Alternatively, the sleeve members could be inserted into the ski body material following the molding operation of the ski, in which case holes would be bored in the ski body material at the appropriate locations and self-locking threaded inserts would be driven either by impact, by pressure or ultrasonically into the bored holes in the ski body material. The inserts prevent stripping under the extreme forces applied to the rudder fin during operative use and prevent the relatively small diameter anchor bolts from lifting or deforming the composite material due to the vertical stresses applied to the anchor bolts.

The rudder fin illustrated includes a plurality of holes 34 spaced along its lower edge which serve to relieve pressure against the lateral surface of the fin 32 during operative use. The fin illustrated in the Drawing also includes a pair of stabilizing wing members 35 mounted to each side of the fin which are angularly adjustable for setting "drag" on the ski as the fin and wings pass through the water.

In operation, the clamping brackets 40*a* and 40*b* are secured to the ski body by means of the plurality of anchor bolts 47*a*. If the embedded anchor sleeve members 49 are of metal construction, the anchor bolts 47*a* can be finely threaded machine bolts, offering significantly stronger anchoring of the clamping brackets 40 to the ski body than has been possible with prior art coarse screw anchoring techniques. Adjustment of the rudder fin 32 relative to the clamping bracket 40 is easily accomplished by loosening the clamping bolts 44 and by turning the appropriate alignment set screws 41*a*, 42*a* and 46 to define the seating parameters for the fin 32. An enlarged view of the adjustment screw engaging relationship with the fin 32 for the rearward set screw 46 and the rearmost upper set screw 42*a* is illustrated in FIG. 5. In the preferred embodiment, the alignment set screws used have twenty threads per inch which translates to a longitudinal movement of 0.040 inches per complete revolution of the set screw. By counting the number of revolutions of an adjustment set screw (or partial revolutions thereof), the actual amount of movement translated to the fin 32 is directly determined by a multiplication of the number of (the number of screw revolutions)×(0.040 inches). Obviously, other thread arrangements could be employed within the spirit and intent of this invention.

When the desired fin adjustment has been made by means of the selected set screws 41*a*, 42*a* and 46, upward and backward pressure (as illustrated in FIG. 3) is applied to the fin 32 to engage the upper and back edges of the fin into firm seating engagement against the set screws 41*a*, 42*a* and 46, and the clamping bolts 44 are retightened. Since the precise amount of adjustment made is known from counting the revolutions of the adjustment screws, there is no issue as to the exact calibrated change in position that has been made to the fin 32 relative to the clamping bracket 40. If a further adjustment is desired, the process is repeated so as to incorporate the new adjustment parameters.

In the event that it is desired to entirely remove the fin 32 from the clamping bracket, for example, due to damage thereto or for transporting of the ski, the clamping bolts 44 are loosened adequately to release the fin 32 from retaining engagement by the clamp 40, and the fin is removed from the ski assembly. When the user wishes to replace the fin, the process is reversed, the clamping bolts 44 are retightened, and the fin 32 will automatically resume its operative position in exactly the same alignment as it had before removal from the ski.

While the preferred embodiment of the invention described above requires the operator to exert upward and backward force against the fin 32 following an adjustment of the adjustment screws, in order to assure engagement of the fin against the adjustment screws, the invention is not limited to this type of embodiment. Those skilled in the art will readily envision adjustment mechanisms which would attach directly to the rudder fin 32 (rather than merely seating against the rudder fin) such that the fin 32 would be automatically moved in an upward or downward direction by the upper adjustment screws, and in both a forward and backward direction by means of the rear adjustment screw 46.

The present invention enables very accurate, calibrated position adjustment to be imparted to the rudder fin, which can be critical to professional skiers who are sensitive to the slightest variation ski performance caused by any movement of the rudder fin. Fin adjustment accurately enables control and modification of the ski behavior for such parameters as: turn initiation, ski tip height, "Off Side" turns, "On Side" turns, angling across the wake and changing edges. For example, with regard to turn initiation, if the ski requires excessive force to initiate turns, horizontal and diagonal adjustments of the fin can help correct the problem. Alternatively, if the ski is unstable or turns with too much speed into the turns, a vertical and/or diagonal adjustment may be necessary. Ski tip height is generally varied by means of vertical adjustments to the fin depth. "Off Side" turn adjustments are generally achieved by diagonal fin adjustments; whereas "On Side" turn adjustments are achieved by horizontal adjustments to the fin position. Adjustments for altering the responsiveness of the ski when angling across a wake are generally achieved by horizontal adjustments to the fin position, and the rate at which the ski changes edges can be determined by proper vertical and horizontal fin position adjustments.

A diagrammatic representation of various modes of fin position adjustments achievable with the calibrated adjustment technique of the present invention are illustrated in FIGS. 6 through 11. The diagrams of FIGS. 6 through 11 illustrate the capability with this invention of independently adjusting the depths of the forward and rearward ends of the fin by means of the set screws 41*a* and 42*a* respectively, and the capability of independently adjusting the fin's longitudinal position relative to the ski body by means of the set screw 46. Referring thereto, FIG. 6 illustrates adjustment of the entire fin in an upward direction that would be achievable by rotating both the set screws 41*a* and 42*a* by the same amount in a counterclockwise direction. FIG. 7 illustrates a diagonal fin adjustment wherein the forward portion of the fin is raised by adjusting only the set screw 41*a* in the counterclockwise direction. FIG. 8 illustrates a diagonal position adjustment which causes the forward edge of the fin to lower and the rearward portion of the fin to rise, which may, for example, be achieved by rotating the set screw 41*a* in the clockwise direction and the set screw 42*a* in the counterclockwise direction. FIG. 9 illustrates shifting of the entire fin in the rearward direction which is achieved by rotating the set screw 46 in the counterclockwise direction. FIG. 10 illustrates movement of the entire fin in the forward direction which is achieved by rotating the set screw 46 in the clockwise direction. FIG. 11 illustrates lowering the entire fin by rotating both set screws 41*a* and 42*a* by equal amounts in the clockwise direction.

While specific examples of fin position adjustment possibilities have been illustrated in FIG. 6 through 11, it will be understood by those skilled in the art, that such representations are not exhaustive of the number or degree of calibrated position adjustments possible by use of the present invention.

The present invention also includes the improved anchoring technique for the mounting bolts for the rudder fin mounting assembly, as herein discussed to some extent previously. As discussed in the Background section of this specification, the forces applied to the rudder fin assembly are substantial, causing severe forces to be applied to the mounting bolts therefore. The problem is significantly accentuated by the fact that the amount of ski body material available at the back end of the ski is minimal due to the severe tapering of the ski toward the back end of the ski. For example, most high-performance slalom skis have a ski width at the back end of only approximately three inches. Prior art rudder fin mounting assemblies have been plagued with the problem of stripped anchor screws caused by the forces imparted to them during operative use of the ski.

The present invention solves this problem by using fairly rigid sleeve anchor members for accepting the anchor bolts in a manner that virtually eliminates the stripping problem. The anchor assemblies are preferably embedded directly into the ski body material during the manufacturing process. One possible technique for accomplishing the embedding process would be to align the fastener anchor members relative to the ski mold at spaced locations therealong which conform to the anchor bolt positions of the fin assembly, and to directly embed the anchor fasteners within the ski body material at the time of forming the ski body in the mold. When the anchor fasteners are embedded directly within the ski body material during the process of fabricating the ski, they are virtually impossible to pull out of or lift from the ski body. An alternative technique would be to insert the anchor fasteners into the completed ski body from the top surface of the ski, after fabrication of the ski body. Using this technique, the ski would first be fabricated, and holes would be bored into the ski body through its upper surface precisely corresponding to the desired anchor fastener locations and the anchor inserts would then be forced into the bored holes from the top side of the ski. The anchor inserts that would be used in this type of process generally include a one-directional fluted or barbed outer surfaces which enable fairly ready insertion of the anchor sleeve into the material in one direction, but prevent movement of the insert back in a removal direction since the flute or barbs engage and penetrate into the ski body material which surrounds them.

While I have disclosed a specific embodiment of my invention, it is to be understood that this is for the purpose of illustration only, and that my invention is to be limited solely by the scope of the appended claims.

What is claimed is:

1. An improved water ski, comprising:

a. an elongated water ski body having top and bottom surfaces and longitudinally extending from a front end to a back end;

b. a rudder fin member operatively mounted to said ski body adjacent said back end thereof and projecting outwardly from said bottom surface of said ski body, and generally symmetrically disposed about a plane of symmetry; and c. means for selectively adjusting the operative position of said rudder fin member relative to said ski body in calibrated manner, wherein said adjusting means enables independent calibrated adjustable movement of said rudder fin member in each of at least two degree of freedom directions within said plane.

2. The water ski of claim 1, wherein said rudder fin member is generally planar and defines an outer peripheral edge surface, and wherein said rudder fin adjusting means includes at least one adjustable bearing surface means for operatively engaging said rudder fin member along said outer peripheral edge surface in a manner which defines the operative calibrated position of said rudder fin member.

3. An improved water ski, comprising:

a. an elongated water ski body having top and bottom surfaces and longitudinally extending from a front end to a back end;

b. a rudder fin member operatively mounted to said ski body adjacent said back end thereof and projecting outwardly from said bottom surface of said ski body, and generally symmetrically disposed about a plane of symmetry; and c. means for selectively adjusting the operative position of said rudder fin member relative to said ski body in calibrated manner, wherein said adjusting means enables calibrated adjustable movement of said rudder fin member with multiple degrees of movement freedom within said plane; and said rudder fin adjusting means further including means for providing uniform calibrated movement of the entire said rudder fin member in a direction generally perpendicular to the general plane of said bottom surface of said ski body.

4. An improved water ski, comprising:

a. an elongated water ski body having top and bottom surfaces and longitudinally extending from a front end to a back end;

b. a rudder fin member operatively mounted to said ski body adjacent said back end thereof and projecting outwardly from said bottom surface of said ski body, and generally symmetrically disposed about a plane of symmetry; and c. means for selectively adjusting the operative position of said rudder fin member relative to said ski body in calibrated manner, wherein said adjusting means enables calibrated adjustable movement of said rudder fin member with multiple degrees of movement freedom within said plane; said rudder fin adjusting means further including means for providing uniform calibrated movement of the entire said rudder fin member in a direction generally parallel to the general plane of said bottom surface of said ski body.

5. An improved water ski, comprising:

a. an elongated water ski body having top and bottom surfaces and longitudinally extending from a front end to a back end;

b. a rudder fin member operatively mounted to said ski body adjacent said back end thereof and projecting outwardly from said bottom surface of said ski body, and generally symmetrically disposed about a plane of symmetry, said rudder fin defining oppositely disposed forward and trailing edges; and c. means for selectively adjusting the operative position of said rudder fin member relative to said ski body in calibrated manner, wherein said adjusting means enables calibrated adjustable movement of said rudder fin member with multiple degrees of movement freedom within said plane; and wherein said adjusting means includes means for selectively moving said rudder fin member so as to independently selectively move said forward and said trailing edges of said rudder fin member relative to said bottom surface of said ski body.

6. An improved water ski, comprising:

a. an elongated water ski body having top and bottom surfaces and longitudinally extending from a front end to a back end;

b. a rudder fin member operatively mounted to said ski body adjacent said back end thereof and projecting outwardly from said bottom surface of said ski body, and generally symmetrically disposed about a plane of symmetry; and c. means for selectively adjusting the operative position of said rudder fin member relative to said ski body in calibrated manner, wherein said adjusting means enables calibrated adjustable movement of said rudder fin member with multiple degrees of movement freedom within said plane; said rudder fin adjusting means further including threaded means for engaging and adjusting the operative position of said rudder fin member in a manner such that rotation of said threaded means imparts movement to said rudder fin member by an amount proportional to the rotation of said threaded means.

7. The water ski of claim 6, wherein said threaded means includes at least one screw member.

8. An improved water ski, comprising;

a. an elongated water ski body having top and bottom surfaces and longitudinally extending from a front end to a back end;

b. a rudder fin member operatively mounted to said ski body adjacent said back end thereof and projecting outwardly from said bottom surface of said ski body, wherein said rudder fin member is generally planar and defines a peripheral edge surface; and c. means for adjusting the operative position of said rudder fin member relative to said ski body in calibrated manner, wherein said rudder fin adjusting means includes a plurality of adjustable bearing surface means for operatively engaging said rudder fin member along said peripheral edge surface in a manner that defines the operative calibrated position of said rudder fin member.

9. The water ski of claim 8, wherein said adjustable bearing surface means control movement of said rudder fin member in at least two directions within the general plane of said rudder fin member.

10. An improved water ski, comprising:

a. an elongated water ski body having top and bottom surfaces and longitudinally extending from a front end to a back end;

b. a general planar rudder fin member operatively mounted to said ski body adjacent said back end thereof and projecting outwardly from said bottom surface of said ski body and generally symmetrically disposed about a plane of symmetry, said rudder fin member defining a peripheral edge surface; and c. means for selectively adjusting the operative position of said rudder fin member relative to said ski body in calibrated manner, wherein said adjusting means enables calibrated adjustable movement of said rudder fin member with multiple degrees of movement freedom within said plane; wherein said adjusting means includes at least one adjustable bearing surface means for operatively engaging said rudder fin member along said peripheral edge surface in a manner which defines the operative calibrated position of said rudder fin member, said adjustable bearing surface means further including at least one rotational threaded member which defines the operative calibrated position of said rudder fin member by an amount proportional to the rotational attitude of said threaded member.

11. A water ski, comprising:

a. an elongated water ski body having top and bottom surfaces and longitudinally extending along an axis from a front end to a back end, said ski body defining an axially aligned slot therethrough adjacent said back end;

b. a generally planar rudder fin member entrained within said slot and sized for movement within said slot;

c. means for securing said rudder fin member to said ski body at a desired operative position within said slot such that at least a portion of said rudder fin member projects outwardly from said bottom surface of said ski body; and d. adjustment means operatively connected with said rudder fin member for selectively adjusting the operative position of said rudder fin member relative to said ski body in calibrated manner; wherein said alignment means enables precise independent calibrated movement of said rudder fin member in predetermined increments in each of at least two degree of freedom directions within the general plane of said rudder fin member.

12. The water ski of claim 11, wherein said adjustment means is operatively connected to said means for securing said rudder fin member to said ski body.

13. A water ski comprising:

a. an elongated water ski body having top and bottom surfaces and longitudinally extending along an axis from a front end to a back end, said ski body defining an axially aligned slot therethrough adjacent said back end;

b. a generally planar rudder fin member entrained within said slot and sized for movement within said slot;

c. means for securing said rudder fin member to said ski body at a desired operative position within said slot such that at least a portion of said rudder fin member projects outwardly from said bottom surface of said ski body; and d. adjustment means operatively connected with said rudder fin member for selectively adjusting the operative position of said rudder fin member relative to said ski body in calibrated manner; said adjustment means including at least one threaded member having an axis that lies in the general plane of said rudder fin member, said threaded member being rotatable about said axis; wherein said alignment means enables precise calibrated movement of said rudder fin member in predetermined increments and with multiple degrees of freedom within the general plane of said rudder fin member.

14. The water ski of claim 13, wherein said adjustment means includes a plurality of said threaded members movable about their respective axes that respectively lie in the general plane of said rudder fin member.

15. An adjustable rudder fin assembly for a water ski having a ski body defining top and bottom ski surfaces and extending between front and back ends, comprising:

a. a rudder fin member;

b. means connected with said rudder fin member for operatively securing said rudder fin member to said water ski body; and c. adjustment means operatively connected with said rudder fin member and with said securing means for independently selectively adjusting the operative position of said rudder fin member relative to said ski body in each of at least two different degree of freedom directions, in calibrated manner; so as to enable said entire rudder fin member to be adjustably moved with predetermined accuracy.

16. The adjustable rudder fin assembly of claim 15, wherein said rudder fin member is generally planar and wherein said adjustment means includes means for moving said rudder fin member in the general plane of said rudder fin member.

17. The adjustable rudder fin assembly of claim 15, wherein said rudder fin member is generally planar and defines an outer peripheral edge surface, and wherein said adjustment means includes at least one adjustable bearing surface means for operatively engaging said rudder fin member along said outer peripheral edge surface in a manner which defines the operative calibrated position of said rudder fin member.

18. An adjustable rudder fin assembly for a water ski having a ski body defining top and bottom ski surfaces and extending between front and back ends, comprising:

a. a rudder fin member;

b. means connected with said rudder fin member for operatively securing said rudder fin member to said water ski body; and c. adjustment means operatively connected with said rudder fin member and with said securing means for selectively adjusting the operative position of said rudder fin member relative to said ski body, in calibrated manner, so as to enable said entire rudder fin member to be adjustably moved with predetermined accuracy with at least two degrees of movement freedom; wherein said adjustment means includes threaded means for engaging and adjusting the operative position of said rudder fin member in a manner such that rotation of said threaded means imparts movement to said rudder fin member by an amount proportional to the rotation of said threaded means.

19. The adjustable rudder fin assembly of claim 18, wherein said threaded means is operatively connected to said means for securing said rudder fin member to said water ski body.

20. An adjustable rudder fin assembly for a water ski having a ski body defining top and bottom ski surfaces and extending between front and back ends, comprising:

a. a rudder fin member;

b. means connected with said rudder fin member for operatively securing said rudder fin member to said water ski body, said securing mans including clamping means for engaging and clamping said rudder fin member in fixed position relative to said securing means when said ruder fin member is positioned at the desired calibrated position; and c. adjustment means operatively connected with said rudder fin member and with said securing means for selectively adjusting the operative position of said rudder fin member relative to said ski body, in calibrated manner, so as to enable said entire rudder fin member to be adjustably moved with predetermined accuracy with at least two degrees of movement freedom.

21. An improved water ski, comprising:

a. a water ski body defining a bottom and longitudinally extending between a front end and a back end;

b. a rudder fin member having forward and rear edges;

c. means for operatively mounting said rudder fin member to said ski body at a position adjacent said back end of said body wherein said forward edge of said rudder fin member faces said front end of the water ski body; and d. adjustment means operatively connected with said rudder fin member for selectively adjusting the operative position of said rudder fin member relative to said ski body, in calibrated manner, such that the forward and rearward edges of said rudder fin member can be independently adjustably positioned relatively to said ski body bottom.

22. The water ski of claim 21, wherein said rudder fin mounting means includes at least one fastener member permanently secured within said water ski body.

23. The water ski of claim 22, wherein said fastener member comprises a sleeve member suitable for cooperatively retainably holding a threaded fastener, and wherein said sleeve member comprises at least in part a material different from that material of said ski body in which said fastener member is secured and which retards stripping of threads formed therein for holding said threaded fastener.

24. The water ski of claim 23, wherein said rudder fin mounting means includes a plurality of said sleeve members and a plurality of threaded fasteners cooperatively threaded into said sleeve members for operatively securing said rudder fin member to said ski body.

25. The water ski of claim 21, wherein said adjustment means further comprises means for providing uniform calibrated adjustment movement of the entire rudder fin member in a direction generally parallel to the general plane of said bottom of said ski body.

* * * * *

UNITED STATES PATENT AND TRADEMARK OFFICE

CERTIFICATE OF CORRECTION

PATENT NO. : 5,299,963

DATED : April 5, 1994

INVENTOR(S) : Paul D. Isensee

It is certified that error appears in the above-identified patent and that said Letters Patent is hereby corrected as shown below:

Column 1, line 52, "skier&3" should read --skier's--.

Column 15, line 17, "general" should read --generally--.

Column 13, line 24, "mans" should read --means--.

Column 16, line 17, "relatively" should read --relative--.

Signed and Sealed this

Twenty-eight Day of February, 1995

*Attest:*

*Attesting Officer*

BRUCE LEHMAN

*Commissioner of Patents and Trademarks*